US007907888B2

(12) United States Patent
Sun et al.

(10) Patent No.: US 7,907,888 B2
(45) Date of Patent: Mar. 15, 2011

(54) MOBILE JAMMING ATTACK METHOD IN WIRELESS SENSOR NETWORK AND METHOD DEFENDING THE SAME

(75) Inventors: Hung-Min Sun, Hsinchu (TW); Shih-Pu Hsu, Hsinchu (TW); Chien-Ming Chen, Hsinchu (TW)

(73) Assignee: National Tsing Hua University (TW)

( * ) Notice: Subject to any disclaimer, the term of this patent is extended or adjusted under 35 U.S.C. 154(b) by 529 days.

(21) Appl. No.: 12/111,229

(22) Filed: Apr. 29, 2008

(65) Prior Publication Data

US 2009/0325478 A1 Dec. 31, 2009

(30) Foreign Application Priority Data

Nov. 20, 2007 (TW) ..... 96143842 A

(51) Int. Cl.
*H04K 3/00* (2006.01)

(52) U.S. Cl. ..... 455/1; 455/411; 455/410; 455/515; 370/338; 370/252

(58) Field of Classification Search ..... 455/1, 410, 455/411, 422.1, 435.2, 525, 456.1, 456.2, 455/404.1, 114.1, 404.2, 414.1, 420, 41.2, 455/552.1, 63.1; 370/252, 338, 328, 310.2, 370/331; 342/13, 14, 15, 52, 54
See application file for complete search history.

(56) References Cited

U.S. PATENT DOCUMENTS

| | | | | |
|---|---|---|---|---|
| 6,442,694 | B1 * | 8/2002 | Bergman et al. | 726/22 |
| 7,212,147 | B2 * | 5/2007 | Messano | 342/4 |
| 7,212,148 | B1 | 5/2007 | Torres | |
| 7,574,202 | B1 * | 8/2009 | Tsao et al. | 455/411 |
| 7,606,524 | B1 * | 10/2009 | Frank | 455/1 |
| 2008/0043686 | A1 * | 2/2008 | Sperti et al. | 370/338 |
| 2009/0097531 | A1 * | 4/2009 | Franceschini et al. | 375/133 |

OTHER PUBLICATIONS

A. D. Wood and J. A. Stankovic, Denial of Service in Sensor Networks, Computer, Oct. 2002, pp. 54-62.

W. Ye, J. Heidemann, and D. Estrin, "An Energy-Efficient MAC Protocol for Wireless Sensor Networks", in INFOCOM 2002, pp. 1567-1576.

T. v. Dam and K. Langendoen, "An Adaptive Energy-Efficient MAC protocol for wireless sensor networks", Los Angeles, California, USA, 2003, pp. 171-180.

Y. W. Law, P. Hartel, J. d. Hartog, and P. Havinga, "Link-layer Jamming Attacks on S-MAC", 2005 IEEE, pp. 217-225.

* cited by examiner

*Primary Examiner* — Tan Trinh
(74) *Attorney, Agent, or Firm* — Antonelli, Terry, Stout & Kraus, LLP; Hung H. Bui, Esq.

(57) ABSTRACT

The present invention relates to a mobile jamming attack method applied in a wireless sensor network (WSN) and method defending the same. The mobile jamming attack method is a power exhaustion denial-of-service attack, possesses mobility and self-learning capability and is unable to be defended with existing defending scheme due to its attack to the routing layer of the WSN; the mobile jamming defending method employs multi-topologies scheme to defend the mobile jamming attack so that the affected area is reduced, the base station can still receive reply packets under the attack, and the jammed area can be roughly located and the track of the mobile jammer can be traced.

7 Claims, 5 Drawing Sheets

MOBILE JAMMING ATTACK METHOD IN WIRELESS SENSOR NETWORK AND METHOD DEFENDING THE SAME

CROSS-REFERENCE TO RELATED APPLICATIONS

This application claims all benefits accruing under 35 U.S.C. §119 from Taiwanese Patent Application No. 096143842, filed on Nov. 20, 2007 in the Intellectual Property Office Ministry of Economic Affairs, Republic of China, the disclosure of which is incorporated herein by reference.

TECHNICAL FIELD

The present invention relates to a denial-of-service attacks in a wireless sensor network and the defending scheme thereof, and particularly a power exhaustion denial-of-service attack possessing learning capability and attacking the routing layer of the wireless sensor network in a mobile manner, and a defending scheme for dividing the nodes in a wireless sensor network into a plurality of topologies when the attacker initiates the mobile jamming attack on a certain area to alleviate the damage level of the entire wireless sensor network.

BACKGROUND OF THE INVENTION

There are a lot of types of jamming attacks. The object is to jam the system from providing services in a short term, in which the power exhaustion denial-of-service attack is a very destructive attack. Because the lifespan of sensor nodes in a wireless network is limited by the power consumption of the battery, when the power is exhausted, the sensor nodes can not operate. For example, the attacker can fake a message asking the sensors nodes continuously retransmitting messages to exhaust its energy. In the wireless sensor network, the data transmission is the most power-consuming.

The jamming attack can be initiated on the link layer or the physical layer. The jamming attack on the link layer employs a jammer to interfere the communication among the sensor nodes. This kind of jamming attack actually employs some weaknesses of the link layer protocol. The jamming attack on the physical layer employs the radio frequency to interfere the opened wireless environment. Because the sensor node only has a single channel, the jammer will seize the usage right of the channel, the sensor node could not transmit the sensing message to the base station.

However, for the conventional jamming attack, after the attacker distributing the mobile jammer initiating the jamming attack to the wireless sensor network, the location of the attacker initiating the jamming attack is the location of distribution. At this time, the jammed sensor node is possibly the unimportant node in a role among the wireless sensors, so that the affected range to the entire wireless sensor network is not so large.

Based on the conventional jamming attack, the defending scheme can be classified into an active mode and a passive mode. The active mode can detect the occurred attack and find out the jammed areas. However, this kind of defending scheme will increase the overhead of transmission and operation of the sensor node, and will easily exhaust the lifespan of the sensor node.

The passive mode employs modifying the MAC layer protocol or reducing the packet transmission frequency to achieve the purpose of power saving. S-MAC (Sensor MAC) and T-MAC (Timeout MAC) are the associated communication protocol. S-MAC employs the periodical sleep mode to make the wireless sensor enter the sleep state to achieve the power-saving effect, but entering the sleep state will stop the data transmission and cause the sleep delay. T-MAC reduces the working period to achieve the purpose of power-saving, but it did not consider the data transmission performance and the problem of sleep delay. Furthermore, except of the above-mentioned problems, both communication protocols, S-MAC and T-MAC have a common defect under the jamming attack, which is that both of the communication protocols will be destroyed by only jamming the data packets and the control packets.

To this end, the applicant has developed the "denial-of-service attacks in a wireless sensor network and the defending scheme thereof" as the present application, so as to improve the defects in the prior art.

SUMMARY OF INVENTION

The first object of the present invention is to provide a mobile denial-of-service attack method applied in a wireless sensor network having a plurality of sensor nodes. The method includes the following steps: (a) distributing a mobile jammer initiating a jamming attack to the wireless sensor network; (b) configuring a jamming threshold; (c) monitoring a network throughput of a sensor node adjacent to the mobile jammer, and learning a data flow direction of the sensor node; (d) determining if the network throughput of the sensor node is lower than the jamming threshold; (e) continuously moving the mobile jamming toward the upstream along the data flow direction and re-executing step (c) if the network throughput has not reached the jamming threshold; and, (f) otherwise, confirming if the sensor node is located on a critical path of a base station connected to the wireless sensor network, and initiating the attack on the sensor node and at least one sensor node on the neighborhood to generate a jammed area, so that the sensor nodes jammed in the jammed area and at least one affected sensor node in the downstream all fail to transmit data to the base station of the wireless sensor network.

According to the above-mentioned method, the critical path in step (e) is a routing path sequentially connecting the sensor nodes with the network throughput larger than the jamming threshold to the base station of the wireless sensor network.

The above-mentioned method can be applied to military surveillance, field ecological observation, and home security systems.

The second object of the present invention is to provide a mobile denial-of-service defending method, which is applied when there is only one critical path connected to a base station in a wireless sensor network having a plurality of sensor nodes is under the attack of a mobile jammer. The method includes the following steps: (a) dividing the sensor nodes in the wireless sensor network into a plurality of topologies with different data flow direction, in which any one of the sensor nodes belonging to any topology only communicates with other sensor nodes belonging to the same topology; (b) switching at least one jammed sensor nodes in the sensor nodes which fails to transmit data to the base station of the wireless sensor network and at least one affected sensor node in the downstream upon being attacked by the mobile jammer to a power-saving mode and reducing the transmission frequency thereof; (c) making the base station transmit a plurality of data retransmission commands to the respectively affected sensor nodes through unaffected sensor nodes in another topology overlapped with the topology to which the affected sensor nodes belong to request to retransmit the data for the affected sensor nodes lost under the attack of mobile jammer; (d) making the affected sensor nodes retransmit the lost data to the base station through the unaffected sensor nodes in another topology overlapped with the topology to which the affected sensor nodes are belonged; (e) making the jammed sensor nodes periodically check if the mobile jammer has stopped the jamming attack; (f) if the mobile jammer has stopped the jamming attack, informing the jammed sensor nodes and the affected sensor nodes in the downstream to recover an original power supply mode and the transmission frequency, and resuming transmitting sensed data to the base station according to the original topology; and, (g) otherwise, transmitting the sensed data from the affected sensor nodes to the base station through the unaffected sensor nodes in another topology overlapped with the topologies to which the affected sensor nodes belong, and repeating step (e).

According to the above-mentioned method, the topologies to which the sensor nodes belong in step (a) are respectively configured by means of a random number, and establish a corresponding routing path of their own.

The above-mentioned method can be applied for defending a denial-of-service attack initiating in a physical layer, a link layer, and a routing layer.

The above-mentioned method can be applied to military surveillance, field ecological observation, and home security systems.

The objects of the present invention and the achieved effects can be further appreciated by the following embodiments.

DETAILED DESCRIPTION OF PREFERRED EMBODIMENTS

In order to improve the problem in the prior art that the denial-of-service attack is not provided with mobility and learning capability causing the limited affected range to the entire wireless sensor network and the defending method for the denial-of-service attack being not able to defend the mobile jamming service attack, the present application provides an innovative mobile denial-of-service attack, which can attack the routing layer of the wireless sensor network, and can not be defended by the current defending method for denial-of-service attack, and further provides a defending method for denial-of-service attach by dividing into multiple topologies to defend the mobile jamming service attack. The following description regarding to the present invention are only examples, which are used for further understanding by the skilled in the art, but not for limiting the present invention.

Figure 1:
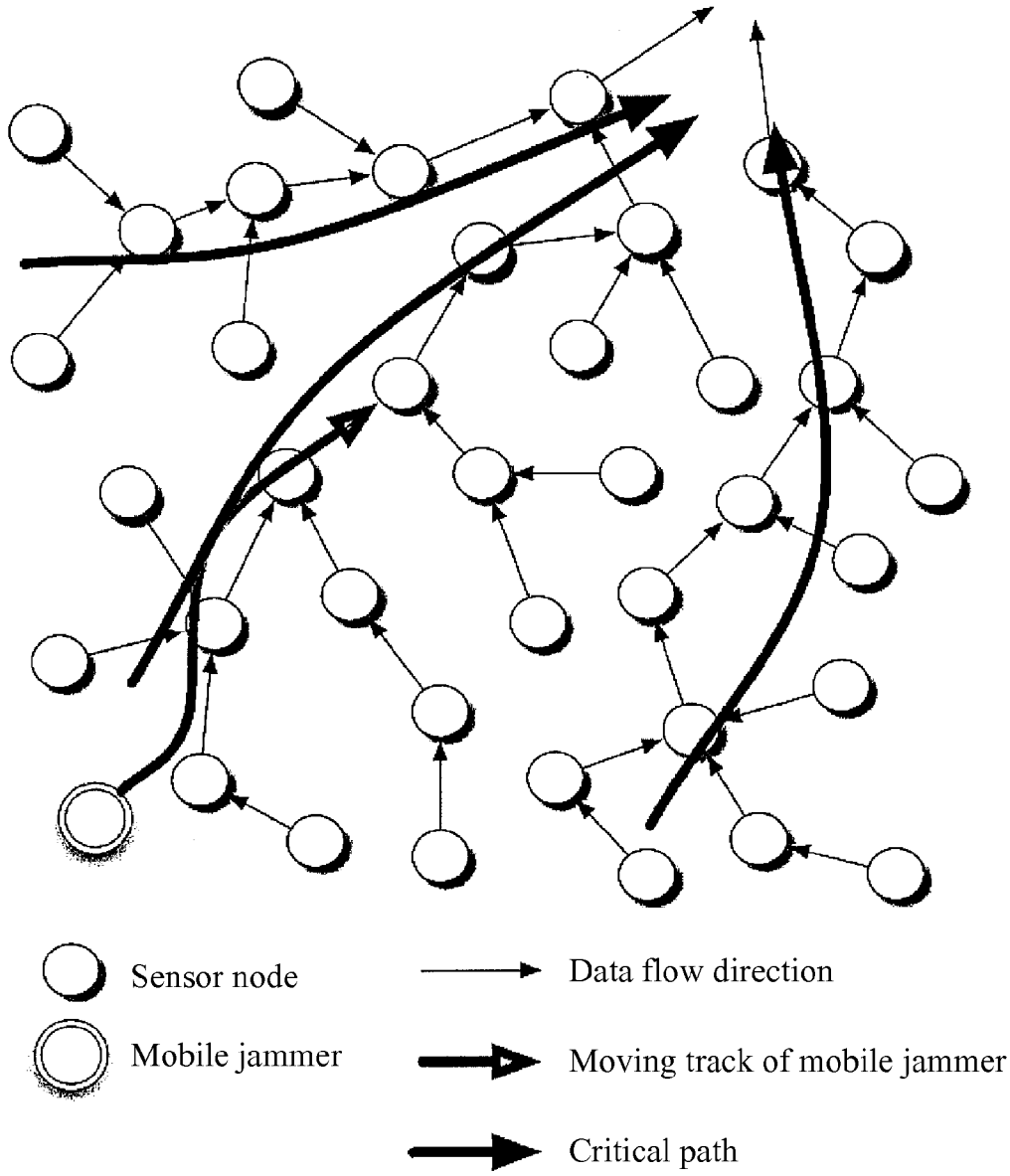
FIG. 1 shows a learning diagram before the mobile jamming attack in a wireless sensor network in a preferred embodiment according to the present invention.
Figure 2:
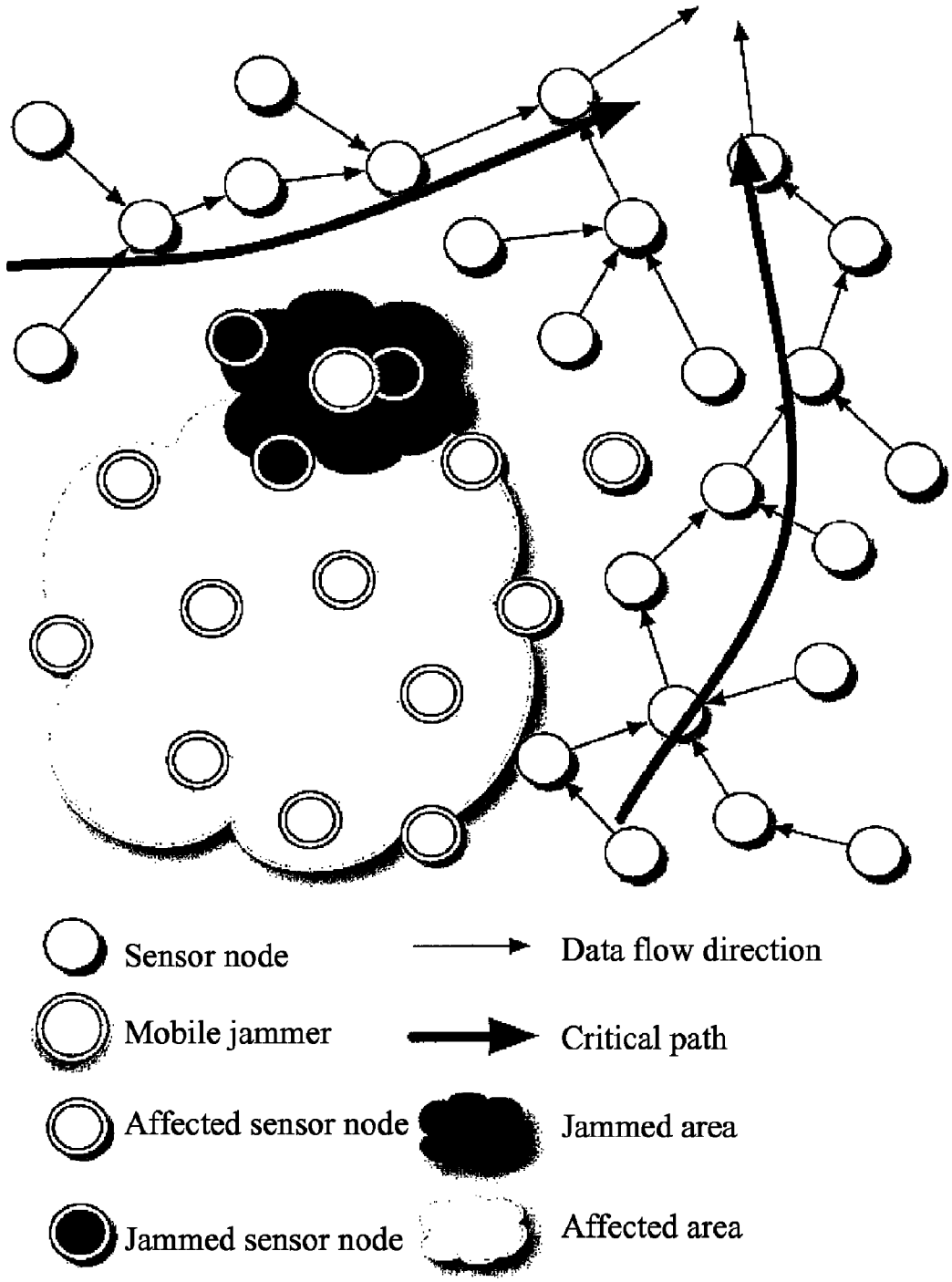
FIG. 2 shows a diagram for the sensor nodes in a wireless sensor network after being jammed and affected by the mobile jamming attack in a preferred embodiment according to the present invention.

First, the technical process for the mobile jamming service attack according to the present invention is described as follows:

FIG. 1 shows a learning diagram before the mobile jamming attack in a wireless sensor network in a preferred embodiment according to the present invention, and FIG. 2 shows a diagram for the sensor nodes in a wireless sensor network after being jammed and affected by the mobile jamming attack in a preferred embodiment according to the present invention. After the attacker distributed the mobile jammer initiating the jamming attack to a wireless sensor network, it will not attack immediately, but monitor the network throughput loading of the sensor nodes on the neighborhood and learn the data flow of the neighbored nodes, and then configure a jamming threshold. If the network throughput loading did not reach the jamming threshold, the mobile jammer will continuously move toward the direction of data flow, and continuously monitor the network throughput loading of the neighbored nodes until the network throughput loading reached the jamming threshold, which indicates that it has tracked a critical path and then initiate the attack. As shown in FIG. 1, the so-called critical path represents the critical routing path among all routing paths in a wireless sensor network, which is normally connected to the base station. The nodes on a critical path all play very important roles. By the mobile jamming attack, the network nodes in the downstream of the critical path could not transmit the data back to the base station, and the affected range of the wireless sensor network will be very large. As shown in FIG. 2, it will cause a large-scale effect only by attacking the critical path.

Figure 3:
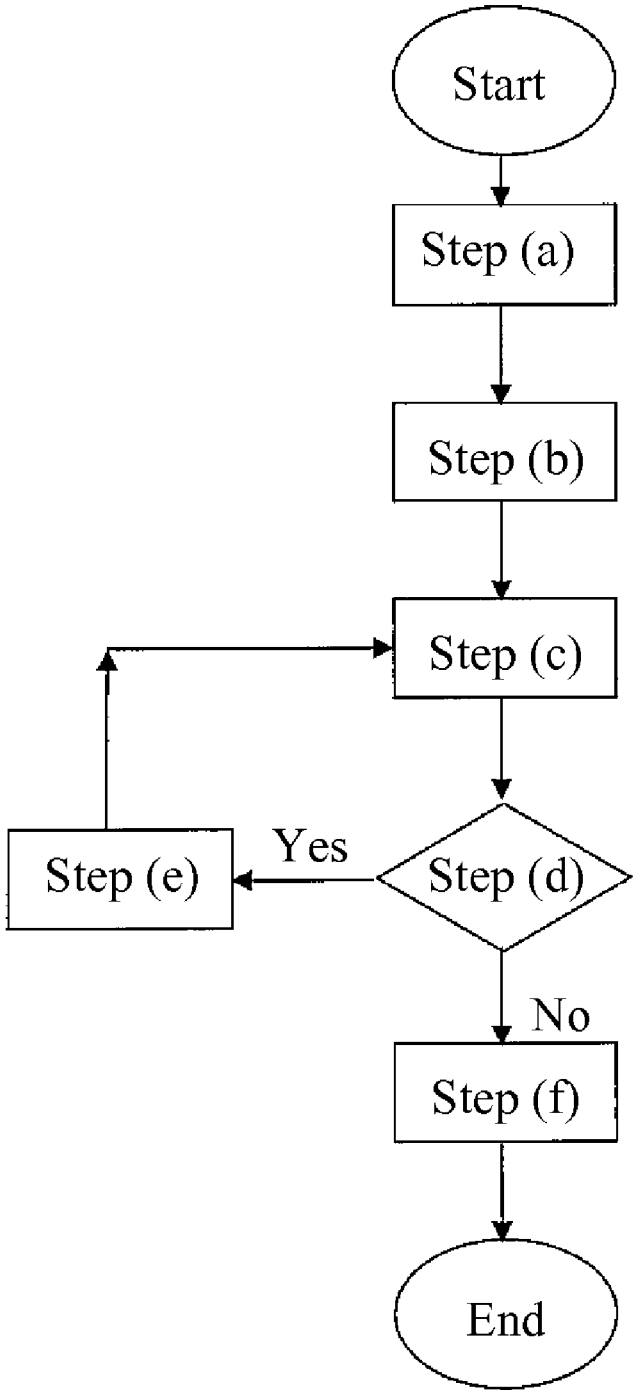
FIG. 3 shows a flow chart of the mobile jamming attack in a wireless sensor network of a preferred embodiment according to the present invention.

In a summary, FIG. 3 shows a flow chart of the mobile jamming attack in a wireless sensor network of a preferred embodiment according to the present invention. The mobile jamming service attack method according to the present invention includes the following steps:

(a) distributing a mobile jammer initiating a jamming attack to the wireless sensor network;

(b) configuring a jamming threshold;

(c) monitoring a network throughput of a sensor node adjacent to the mobile jammer, and learning a data flow direction of the sensor node;

(d) determining if the network throughput of the sensor node is lower than the jamming threshold;

(e) continuously moving the mobile jamming toward the upstream along the data flow direction and re-executing step (c) if the network throughput has not reached the jamming threshold; and (f) otherwise, confirming if the sensor node is located on a critical path of a base station connected to the wireless sensor network, and initiating the attack on the sensor node and at least one sensor node on the neighborhood to generate a jammed area, so that the sensor nodes jammed in the jammed area and at least one affected sensor node in the downstream all fail to transmit data to the base station of the wireless sensor network.

Figure 4:
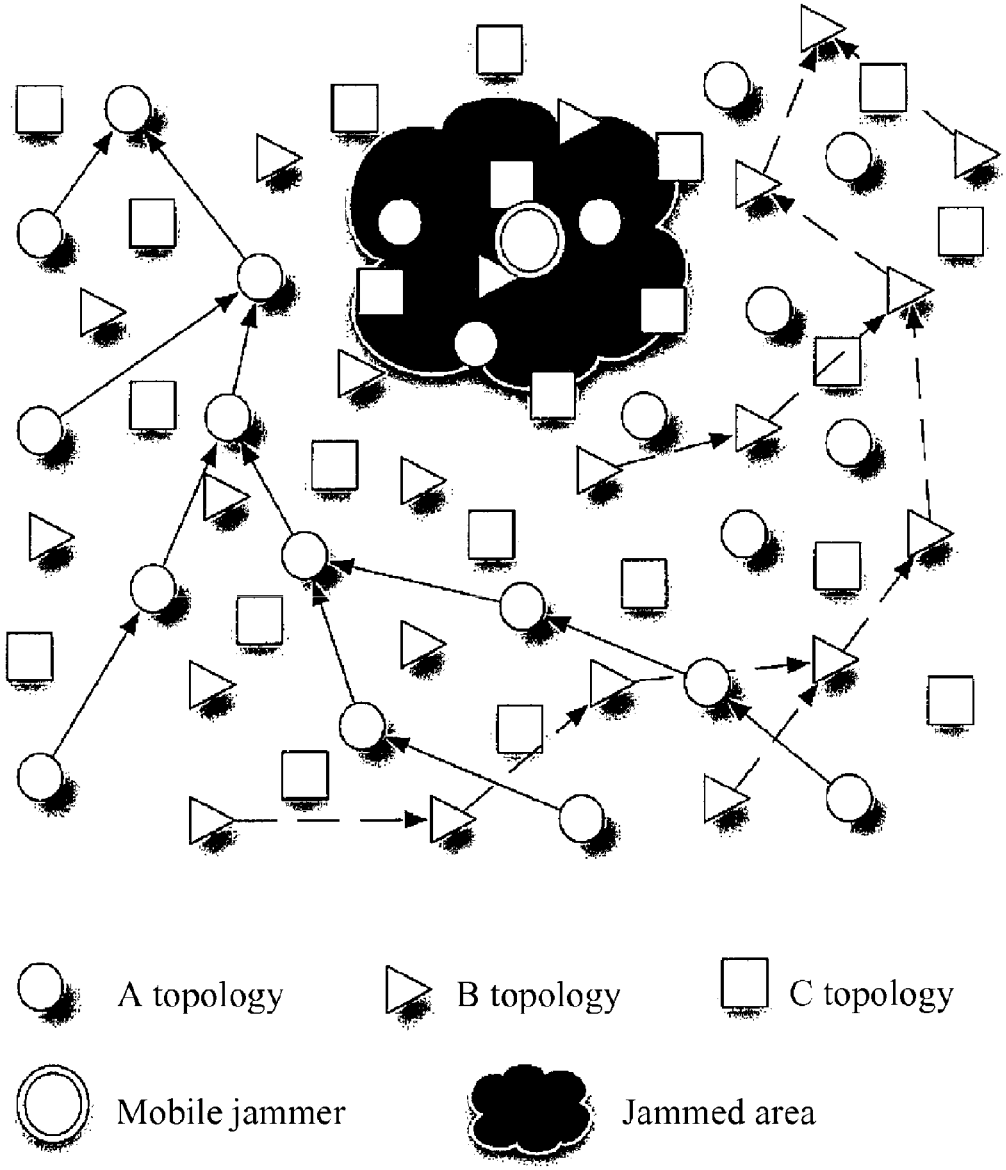
FIG. 4 shows a diagram of dividing multiple topologies in the defending method for mobile denial-of-service according to the present invention in another preferred embodiment according to the present invention.

Next, the technical process for the defending method of the mobile jamming service attack according to the present invention is described as follows:

FIG. 4 shows a diagram of dividing multiple topologies in the defending method for mobile denial-of-service according to the present invention in another preferred embodiment according to the present invention. Before the disposition of wireless sensors, they could be evenly divided into many equivalent portions. The sensor nodes will be divided into three equivalent portions hereinafter for the convenience of explanation. FIG. 4 employs three shapes to indicate the sensor nodes in three equivalent portions. In a wireless sensor node, we employed random numbers for disposition. These sensor nodes will self-establish the routing paths forming three topologies. When the mobile jammer initiates the mobile jamming attack on a certain area, the mobile jammer causes different damage levels to the three topologies. If the critical path of topology C is jammed, the jammed sensor nodes and the affected sensor nodes in the downstream will be switched to power-saving mode and reducing the transmission frequency, and will periodically check if the mobile jammer has stopped the jamming attack. At this time, the nodes in the downstream of the critical path in topology C can still transmit the data back to the base station through topologies A and B, so it will not be completely jammed, and the affected range to the entire wireless sensor network will be relative small. If the mobile jammer has stopped the jamming attack, the jammed sensor nodes and the affected sensor nodes in the downstream will recover the original power supply mode and the transmission frequency, and resume transmitting the sensed data to the base station according to the original topology. Although the embodiment is only divided into three topologies for description, basically the more the number of topologies is, the smaller the affected range by the mobile jamming attack is, and the stronger the defending capability is.

Figure 5:
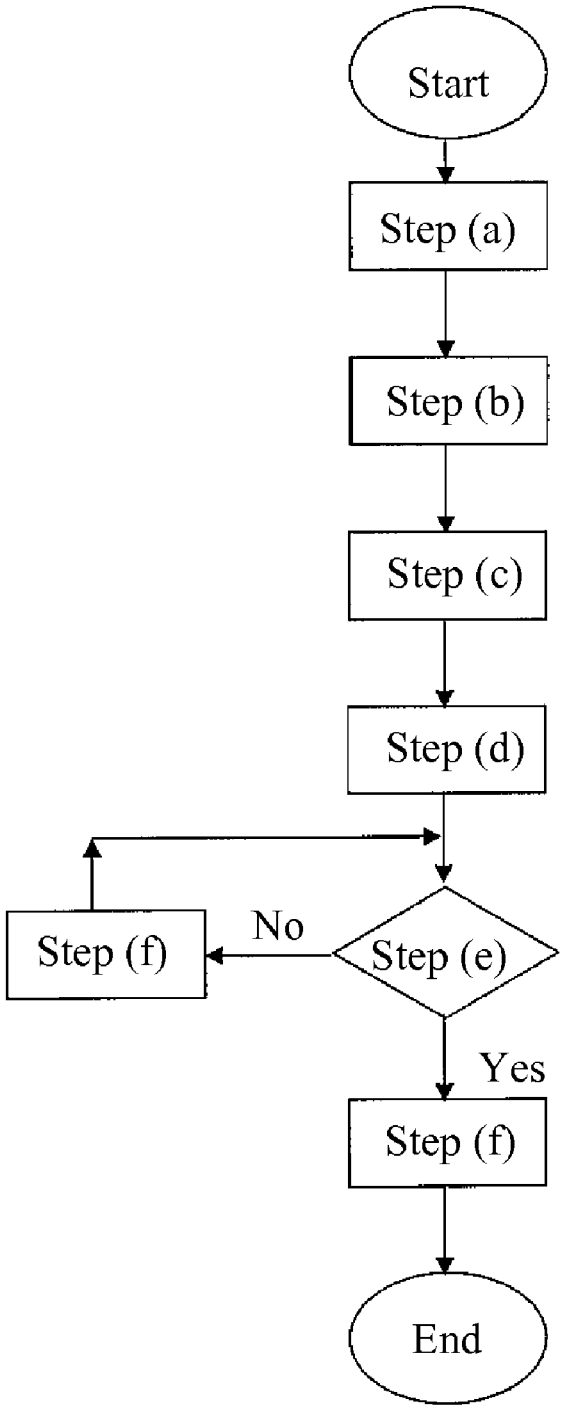
FIG. 5 shows a flow chart of the mobile jamming defending in a wireless sensor network of another preferred embodiment according to the present invention.

In a summary, FIG. 5 shows a flow chart of the mobile jamming defending in a wireless sensor network of another preferred embodiment according to the present invention. The mobile denial-of-service defending method according to the present invention includes the following steps:

(a) dividing the sensor nodes in the wireless sensor network into a plurality of topologies with different data flow direction, in which any one of the sensor nodes belonging to any topology only communicates with other sensor nodes belonging to the same topology;

(b) switching at least one jammed sensor nodes in the sensor nodes which fails to transmit data to the base station of the wireless sensor network and at least one affected sensor node in the downstream upon being attacked by the mobile jammer to a power-saving mode and reducing the transmission frequency thereof;

(c) making the base station transmit a plurality of data retransmission commands to the respectively affected sensor nodes through unaffected sensor nodes in another topology overlapped with the topology to which the affected sensor nodes belong to request to retransmit the data for the affected sensor nodes lost under the attack of mobile jammer;

(d) making the affected sensor nodes retransmit the lost data to the base station through the unaffected sensor nodes in another topology overlapped with the topology to which the affected sensor nodes are belonged;

(e) making the jammed sensor nodes periodically check if the mobile jammer has stopped the jamming attack;

(f) if the mobile jammer has stopped the jamming attack, informing the jammed sensor nodes and the affected sensor nodes in the downstream to recover an original power supply mode and the transmission frequency, and resuming transmitting sensed data to the base station according to the original topology; and (g) otherwise, transmitting the sensed data from the affected sensor nodes to the base station through the unaffected sensor nodes in another topology overlapped with the topologies to which the affected sensor nodes belong, and repeating step (e).

The above-mentioned mobile denial-of-service attack method and mobile denial-of-service defending method could both be applied to military surveillance, field ecological observation, and home security systems. Moreover, the mobile denial-of-service defending method according to the present invention can not only defend the mobile jamming attack provided by the present invention, but also can defend the denial-of-service attack initiated on any one of a physical layer, a link layer or a routing layer.

In a summary, the present invention provides an innovative mobile jamming attack which has mobility and learning capability and is able to attack the routing layer in a wireless sensor network, and will cause larger damages to the wireless sensor network comparing to the conventional jamming attack; and, also providing a denial-of-service attack defending method by dividing into multiple topologies, which can much reduce the affected range by the jamming attack, and can also approximately position the location and attack path by the jamming attack. The method is provides with practicability and creativity, so that the present invention can effectively improve the defects in the prior art, and further achieve the purpose for developing the present invention.

The prevent invention can be conducted with various modification by the skilled in the art having technical background, which are all not departing from the subjects to be protected by the attached claims.

We claim:

1. A mobile jamming attack method applied in a wireless sensor network having a plurality of sensor nodes, comprising steps of:

(a) distributing a mobile jammer initiating a jamming attack to the wireless sensor network;

(b) configuring a jamming threshold;

(c) monitoring a network throughput of a sensor node adjacent to the mobile jammer, and learning a data flow direction of the sensor node;

(d) determining if the network throughput of the sensor node is lower than the jamming threshold;

(e) continuously moving the mobile jamming upstream along the data flow direction and re-executing step (c) if the network throughput has not reached the jamming threshold; and (f) otherwise, confirming if the sensor node is located on a critical path of a base station connected to the wireless sensor network, and initiating the attack on the sensor node and at least one sensor node on the neighborhood to generate a jammed area, so that the sensor nodes jammed in the jammed area and at least one affected sensor node in the downstream all fail to transmit data to the base station of the wireless sensor network.

2. A method according to claim 1, wherein the critical path in step (e) is a routing path sequentially connecting the sensor nodes with the network throughput larger than the jamming threshold to the base station of the wireless sensor network.

3. A method according to claim 1, wherein the method is applied to military surveillance, field ecological observation, and home security systems.

4. A mobile denial-of-service defending method, which is applied when there is only one critical path connected to a base station in a wireless sensor network having a plurality of sensor nodes is under the attack of a mobile jammer, comprising steps of:

(a) dividing the sensor nodes in the wireless sensor network into a plurality of topologies with different data flow direction, in which any one of the sensor nodes belonging to any topology only communicates with other sensor nodes belonging to the same topology;

(b) switching at least one jammed sensor nodes in the sensor nodes which fails to transmit data to the base station of the wireless sensor network and at least one affected sensor node in the downstream upon being attacked by the mobile jammer to a power-saving mode and reducing the transmission frequency thereof;

(c) making the base station transmit a plurality of data retransmission commands to the respectively affected sensor nodes through unaffected sensor nodes in another topology overlapped with the topology to which the affected sensor nodes belong to request to retransmit the data of the affected sensor nodes lost under the attack of mobile jammer;

(d) making the affected sensor nodes retransmit the lost data to the base station through the unaffected sensor nodes in another topology overlapped with the topology to which the affected sensor nodes are belonged;

(e) making the jammed sensor nodes periodically check if the mobile jammer has stopped the jamming attack;

(f) if the mobile jammer has stopped the jamming attack, informing the jammed sensor nodes and the affected sensor nodes in the downstream to recover an original power supply mode and the transmission frequency, and resuming transmitting sensed data to the base station according to the original topology; and (g) otherwise, transmitting the sensed data from the affected sensor nodes to the base station through the unaffected sensor nodes in another topology overlapped with the topologies to which the affected sensor nodes belong, and repeating step (e).

5. A method according to claim 4, wherein the topologies to which the sensor nodes belong in step (a) are respectively configured by means of a random number, and establish a corresponding routing path of their own.

6. A method according to claim 4, wherein the method is applied for defending a denial-of-service attack initiating in a physical layer, a link layer, and a routing layer.

7. A method according to claim 4, wherein the method is applied to military surveillance, field ecological observation, and home security systems.

* * * * *